US008215995B1

(12) United States Patent
Little et al.

(10) Patent No.: US 8,215,995 B1
(45) Date of Patent: Jul. 10, 2012

(54) CONNECTOR ATTACHED TO A BRACKET AND MOUNTED IN A CUTOUT IN A SUBSTRATE

(75) Inventors: Terrance F. Little, York, PA (US); Kuo-Chun Hsu, Tu-Cheng (TW); Hui-Wen Yang, Tu-Cheng (TW); Ting-Yen Chuang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/986,153

(22) Filed: Jan. 6, 2011

(51) Int. Cl.
*H01R 25/00* (2006.01)

(52) U.S. Cl. ..... 439/638

(58) Field of Classification Search ..... 439/638, 439/660, 607.01, 607.27, 607.35, 367, 79, 439/55

See application file for complete search history.

(56) References Cited

U.S. PATENT DOCUMENTS

| | | | | |
|---|---|---|---|---|
| 6,468,108 | B1 * | 10/2002 | Wu | 439/567 |
| 6,666,694 | B1 * | 12/2003 | Daly et al. | 439/79 |
| 6,752,638 | B2 * | 6/2004 | Na | 439/76.1 |
| 7,438,562 | B2 | 10/2008 | Ni et al. | |
| 7,493,365 | B2 * | 2/2009 | Wies et al. | 709/204 |
| 7,922,536 | B2 * | 4/2011 | Zhang et al. | 439/607.45 |
| 7,985,082 | B2 * | 7/2011 | Sun | 439/131 |
| 8,033,866 | B2 * | 10/2011 | Mao et al. | 439/638 |
| 8,052,430 | B2 * | 11/2011 | Wu | 439/76.1 |
| 2009/0011623 | A1 * | 1/2009 | Hisamatsu et al. | 439/79 |

FOREIGN PATENT DOCUMENTS

TW M377771 4/2009

* cited by examiner

*Primary Examiner* — Chandrika Prasad
(74) *Attorney, Agent, or Firm* — Andrew C. Cheng; Wei Te Chung; Ming Chieh Chang

(57) ABSTRACT

A board-mount connector assembly (1000) includes a substrate (101) defining a cutout (1012) and two arms disposed at opposite sides of the cutout; a bracket (103) mounted to the substrate and disposed under the cutout; a connector (100) sinking in the cutout and supported by the bracket, and at least one wire (106) connected to the connector.

20 Claims, 15 Drawing Sheets

CONNECTOR ATTACHED TO A BRACKET AND MOUNTED IN A CUTOUT IN A SUBSTRATE

BACKGROUND OF THE INVENTION

1. Field of the Invention

The present invention relates to a connector assembly, especially to a lower profile connector assembly mounted to a board or substrate.

2. Description of Related Art

A board-mount connector assembly is widely used in an electronic device. The board-mount connector assembly commonly includes a board/substrate with a number of conductive pads or conductive holes, a connector with an insulative housing and a number of contacts assembled to the insulative housing. The connector is placed on the board/substrate, and the contacts have tail portions soldered to the conductive pads or the conductive pads by SMT or T/H process. However, as the contacts are connected with conductive pads, therefore transmitting path for signals from the connector to other relative components of a system is limited by the board/substrate, sometimes it is not convenient for customer.

As development of electronic industry, an electronic device becomes more and more compact, and components thereof are also required smaller correspondingly. Designers have chosen all methods to reduce dimension of a board-mount connector assembly. Now, a sink type board-mount connector assembly is widely accepted by designers, as sink type connector assembly is smaller than other kinds of board-mount connector assembly, either its dimension along a vertical direction or a longitudinal direction.

For example, TW Pat. No. M377771 on Apr. 1, 2009 issued to He discloses a sink type connector assembly. The connector assembly includes a board with a cutout for a corresponding connector placed therein. The connector has a shielding member with two tabs formed thereon and further gripping the board so as to have the connector reliably mounted to the board. However, relative arrangement between the connector and the board can not be adjusted, as Spec of the connector has been preset.

In another application, a board-mount connector is a port for a memory card assembly.

In current market, one Giga-Byte or larger chips using flash-memory technologies with electrically-erasable programmable read-only memory (EEPROM) are available. Small flash-memory cards have been designed to have a connector that can be plugged into a specialized (special/particular) reader, such as for compact-flash, secure-digital, memory stick, or other standardized formats. Recently, flash memory cards are sold with a USB port. Such USB-flash memory cards do not require a specialized reader but can be plugged into a USB connector on a personal computer (PC) or other hosting device. These USB-flash memory cards can be used to replace floppy disks and are known as USB key drives, USB thumb drives, and a variety of other names. These USB-flash cards can have a storage capacity of more than ten floppy disks in an area not much larger than a large postage stamp.

For example, U.S. Pat. No. 7,438,562 on Oct. 21, 2008 issued to Ni et al. discloses universal serial bus (USB) flash-memory device. The device has an integrated slim Universal-Serial-Bus (USB) connector that fits into a standard USB socket. The slim USB connector has four metal contacts on a circuit board that is encapsulated by a plastic case. Components are mounted onto the circuit board. A plastic cover encloses the circuit board. However, as the USB connector is also a part of the flash-memory device, and could not be demounted from the flash-memory device, and may bring some problem in repairing process.

Hence, an improved board-mount connector assembly is required to overcome the problems of the prior art.

SUMMARY OF THE INVENTION

An object of the present invention is to provide a lower profile board-mount connector assembly.

Accordingly, to achieve above-mentioned object, a board-mount connector assembly comprises a substrate defining a cutout; a bracket attached to the substrate and spanning over the cutout; and a connector attached to the bracket and disposed at least a portion within the cutout; and at least one wire connected to the connector.

The detailed features of the present invention will be apparent in the detailed description with appropriate reference to the accompanying drawings.

DETAILED DESCRIPTION OF THE INVENTION

Reference will now be made in detail to the preferred embodiment of the present invention.

Figure 1:
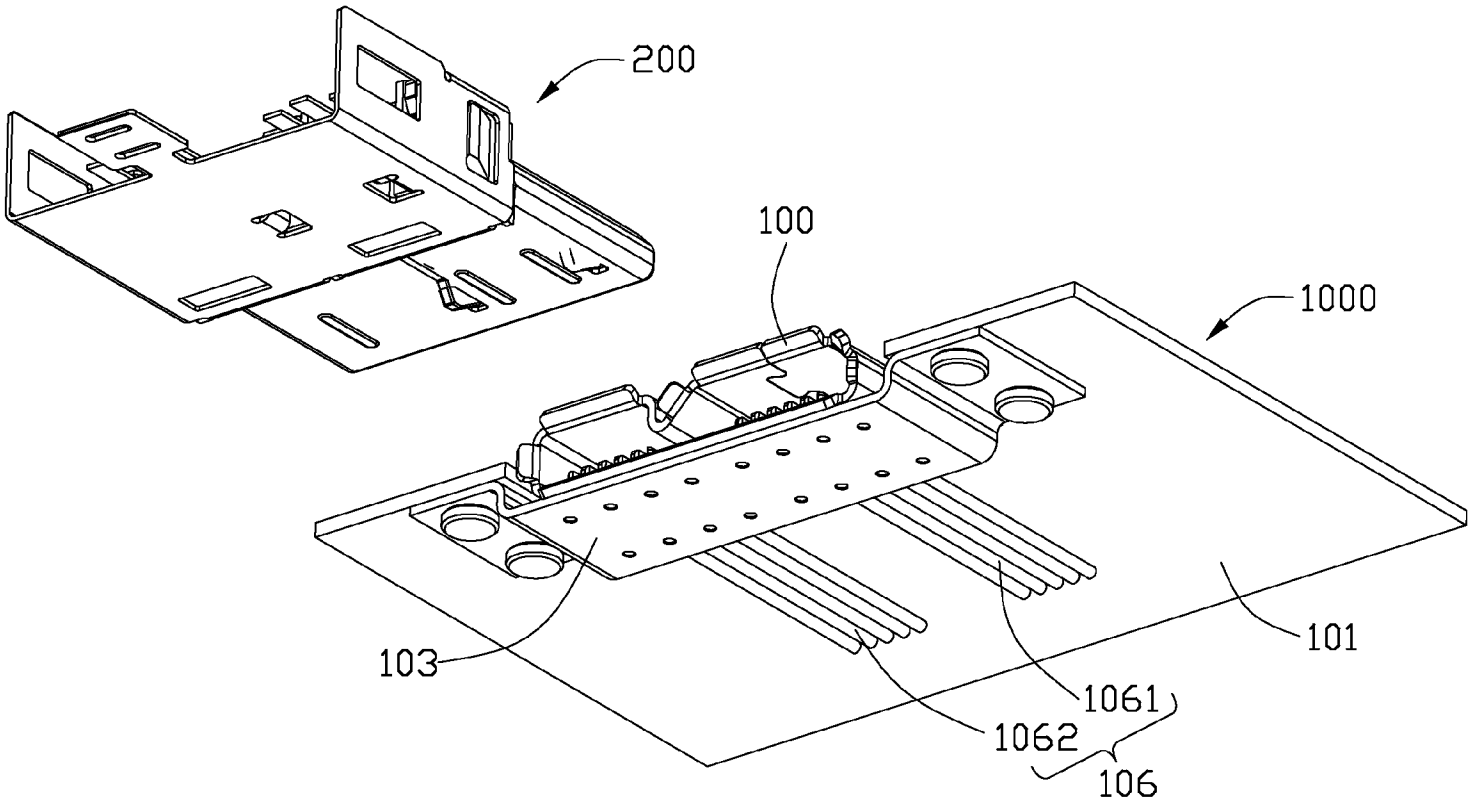
FIG. 1 is a perspective view of a board-mount connector assembly and a plug connector adapted for mating with the board-mount connector assembly of a first embodiment in accordance with the present invention.
Figure 2:
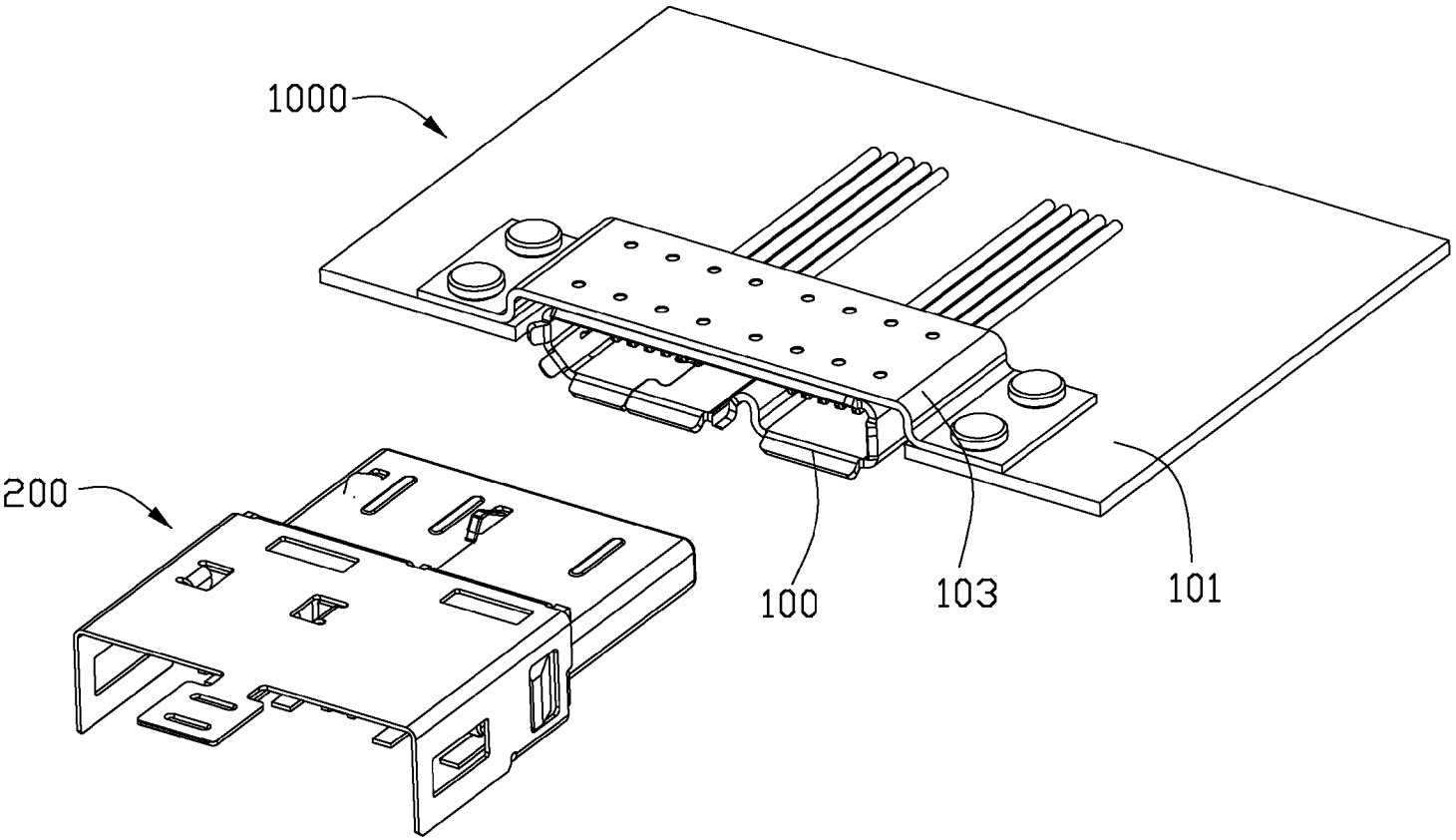
FIG. 2 is similar to FIG. 1, but viewed from other aspect.
Figure 3:
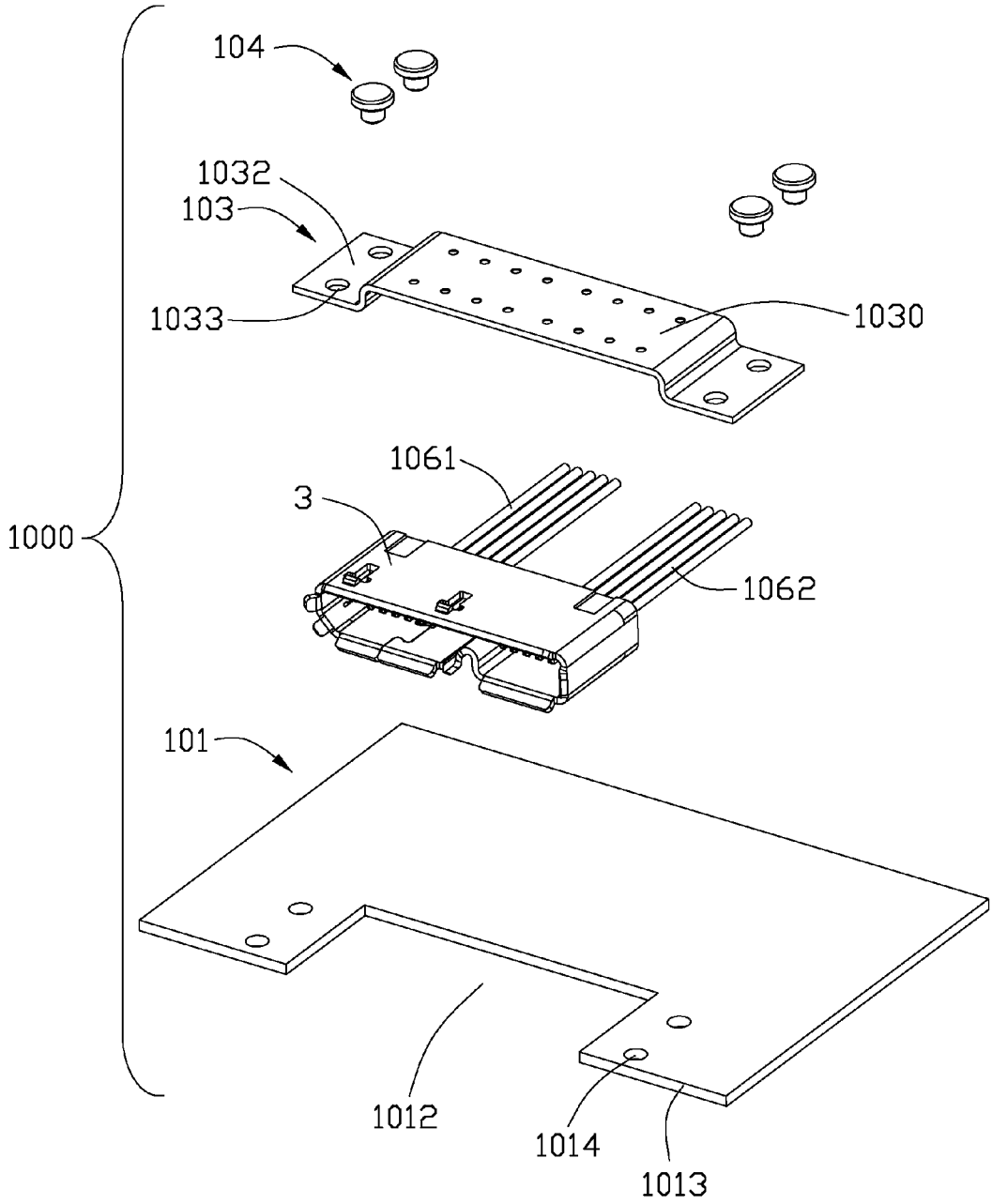
FIG. 3 is a partially exploded, perspective view of the board-mount connector assembly.
Figure 4:
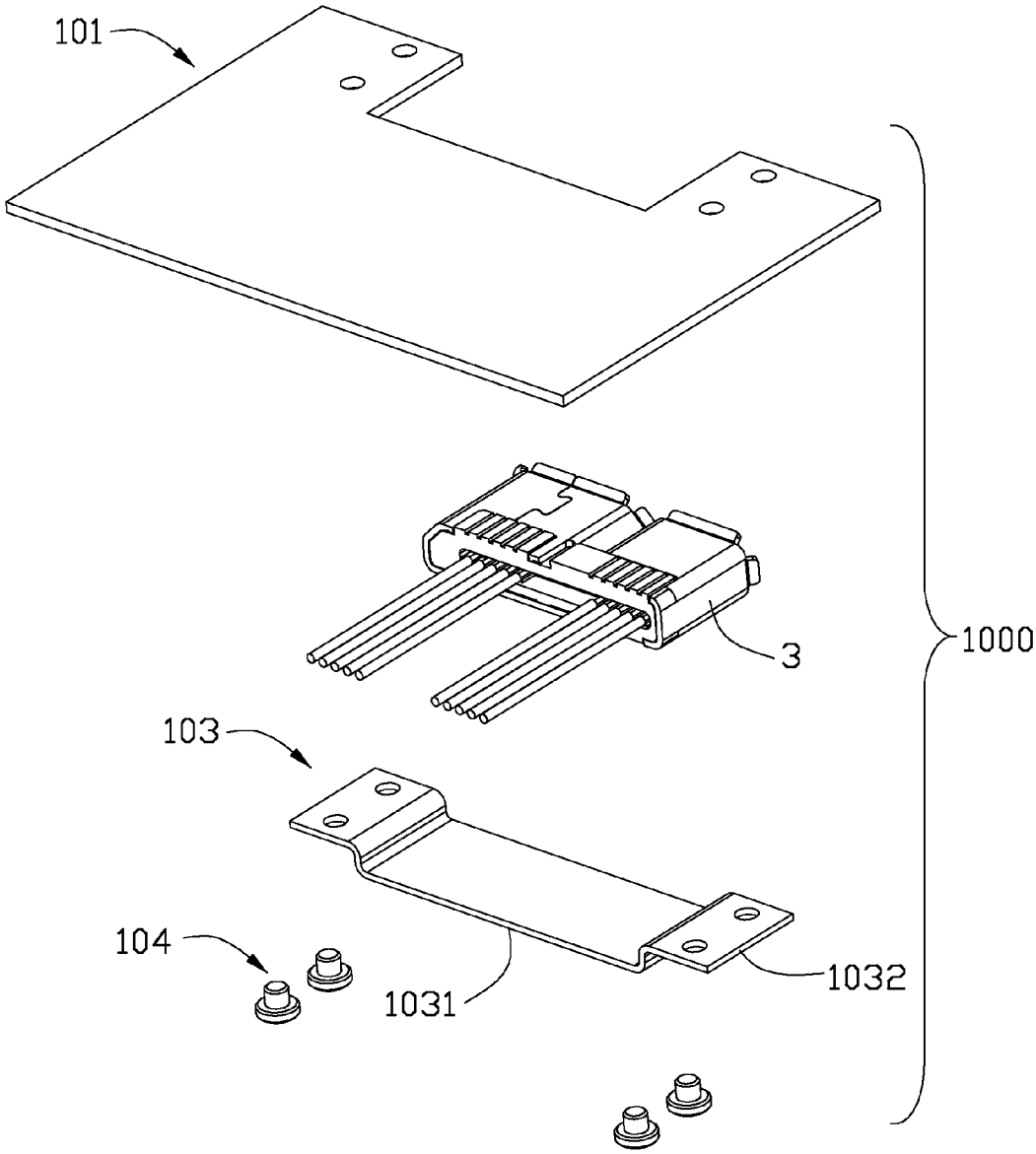
FIG. 4 is similar to FIG. 3, but viewed from other aspect.
Figure 5:
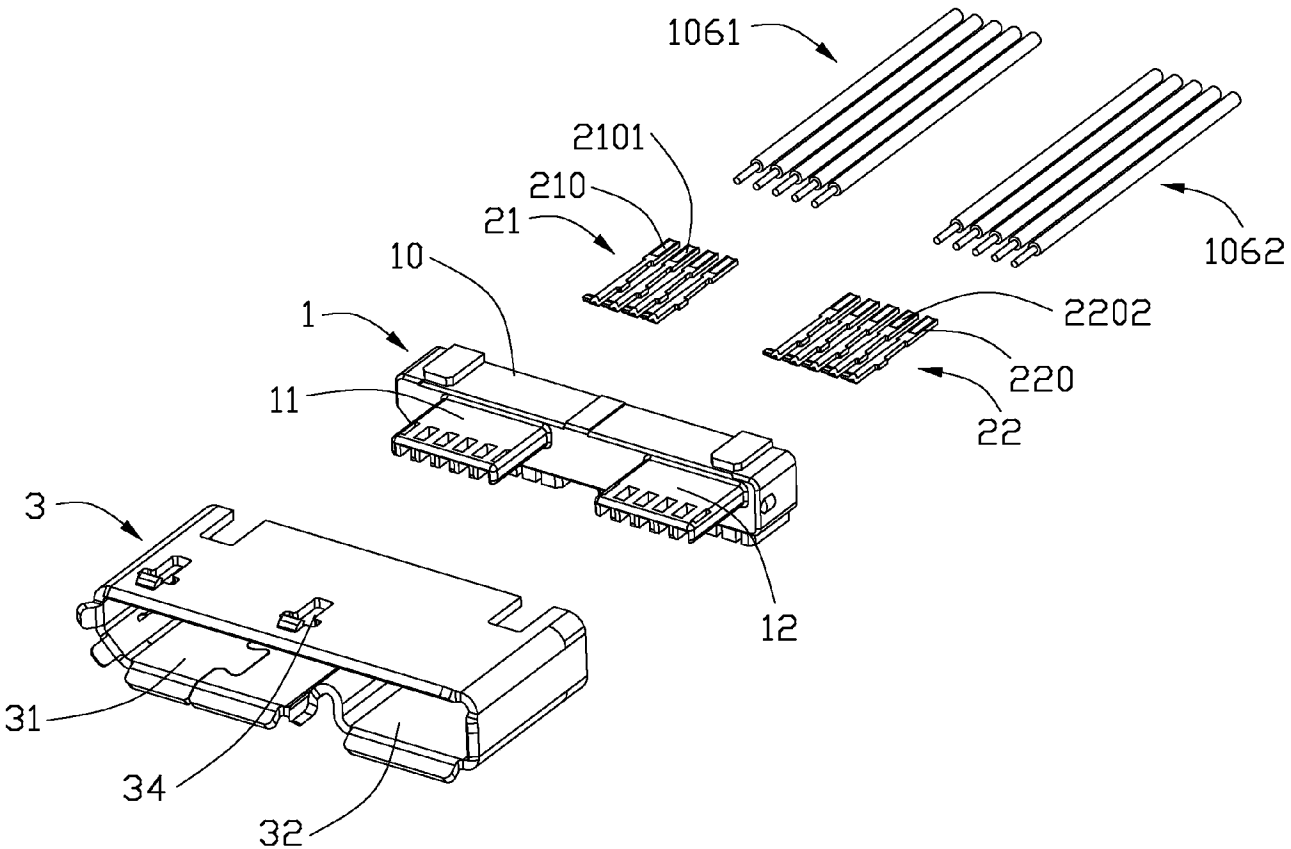
FIG. 5 is an exploded perspective view of a receptacle connector in FIG. 3.
Figure 6:
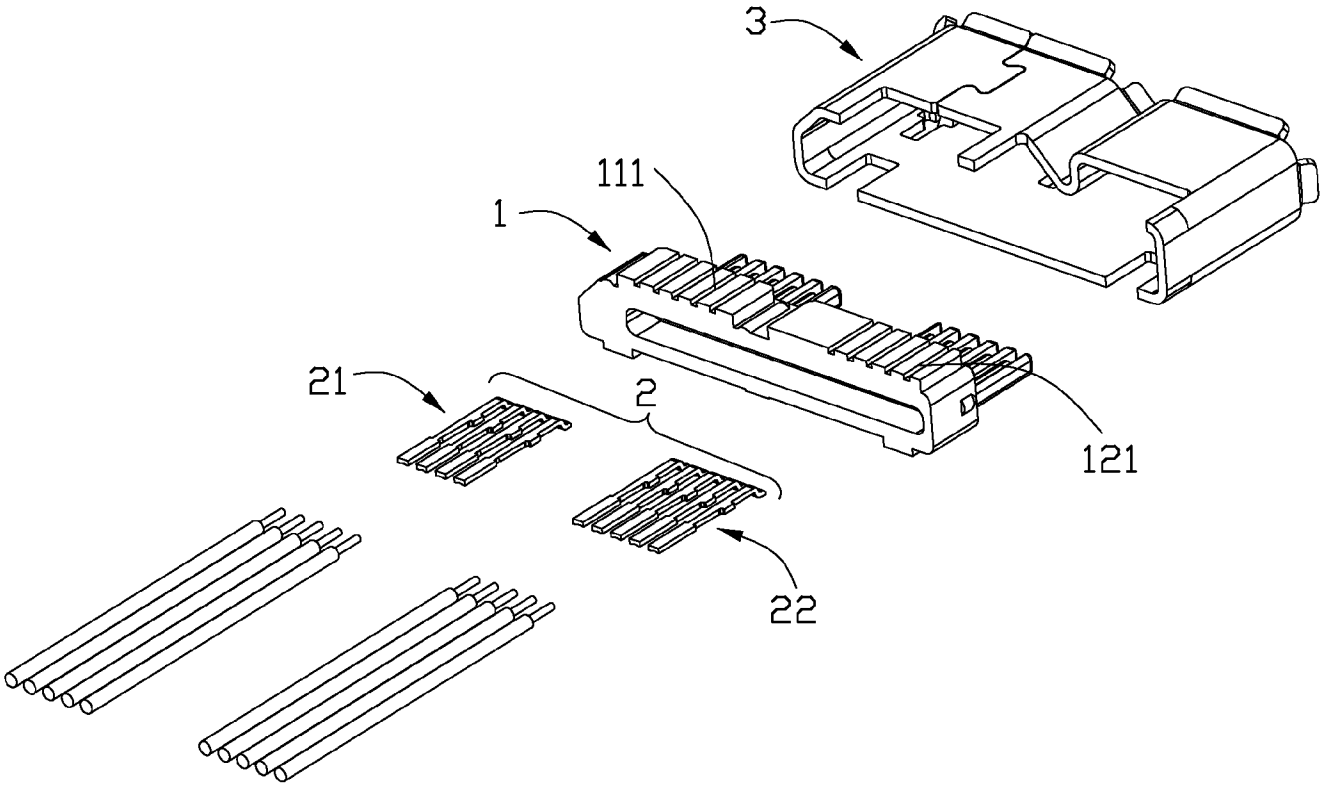
FIG. 6 is similar to FIG. 5, but viewed from other direction.

Referring to FIGS. 1-2, a board-mount connector assembly 1000 with a first connector 100 adapted for mating with a second connector 200 of a first embodiment in accordance with the present invention.

Referring to FIGS. 3-6 in conjunction with FIGS. 1-2, the board-mount connector assembly 1000 includes a substrate/board 101, a first connector 100, a bracket 103 mounted to the substrate 101 to support the first connector 100 and a plurality of wires 106 connected/terminated to the first connector 100. The first connector 100 is a receptacle connector.

The first connector 100 is a universal serial bus (USB) connector and includes an insulative housing 1, a plurality of contacts 2 mounted to the insulative housing 1, a metallic shell 3 enclosing the insulative housing 1.

The insulative housing 1 has a transversal base portion 10, a first tongue portion 11 and a second tongue portion 12 extending forwardly from the base portion 10. The first tongue portion 11 and the second tongue portion 12 are separated from each other along a transversal direction. The first tongue portion 11 has a plurality of first contact grooves 111, and the second tongue portion 12 also has a plurality of second contact grooves 121. The first contacts 21 and the second contacts 22 are respectively accommodated in the first contact grooves 111 and the second contact grooves 121. The first contacts 21 are in accordance with Micro USB contact arrangement; while the second contacts 22 are in accordance with Micro USB 3.0 arrangement, with two differential signal contacts and a grounding contact disposed therebetween. The metallic shell 3 has a first receiving port 31 and a second receiving port 32 for accommodating the first tongue portion 11 and the second tongue portion 12. The first receiving port 31 and the second receiving port 32 have different shape.

The substrate 101 defines a cutout 1012 at a front segment thereof. There are two arms 1013 located at opposite sides of the cutout 1012. Each arm 1013 defines two mounting holes 1014 and arranged along a front-to-back direction.

The bracket 103 has a U-shaped retainer 1031 and two horizontal mounting portions 1032 outwardly extending from upper edges of the U-shaped retainer 1031. There are two holes 1033 defined in each mounting portion 1032. The wires 106 are divided into a group of first wires 1061 and a group of second wires 1062 along the transversal direction.

The bracket 103 is assembled to the substrate 101, with the retainer 1031 disposed under the cutout 1012 and the two mounting portions 1032 placed on the two arms 1013. Therefore, the bracket 103 spans over the cutout 1012. The mounting portions 1032 and the arms 1013 are combined together, with corresponding rivets 104 assembled to the holes 1033 of the mounting portions 1032 and the mounting holes 1014 of the arms 1013. The first connector 100 is mounted to the retainer 1031 and sinks inside the cutout 1012 of the substrate 101, with the lower side 30 of the metallic shell 30 placed on and supported by the bottom side 1030 of the retainer 1032. Hence, the first connector 100 is attached to the bracket 103 and disposed at least a portion within the cutout 1012. Tail portions 210, 220 of the first contacts 21 and the second contacts 22 are soldered to the first wires 1061 and the second wires 1062. In addition, there is a depressed soldering cup 2101/2102 on each tail portion 210/220 for positioning an inner conductor of a corresponding wire in soldering process. By such arrangement, the first connector 100 may be connected to any other elements via the wires, not restricted by the substrate, therefore depending on customer's purpose, and it's free to link it anywhere in the system.

Figure 7:
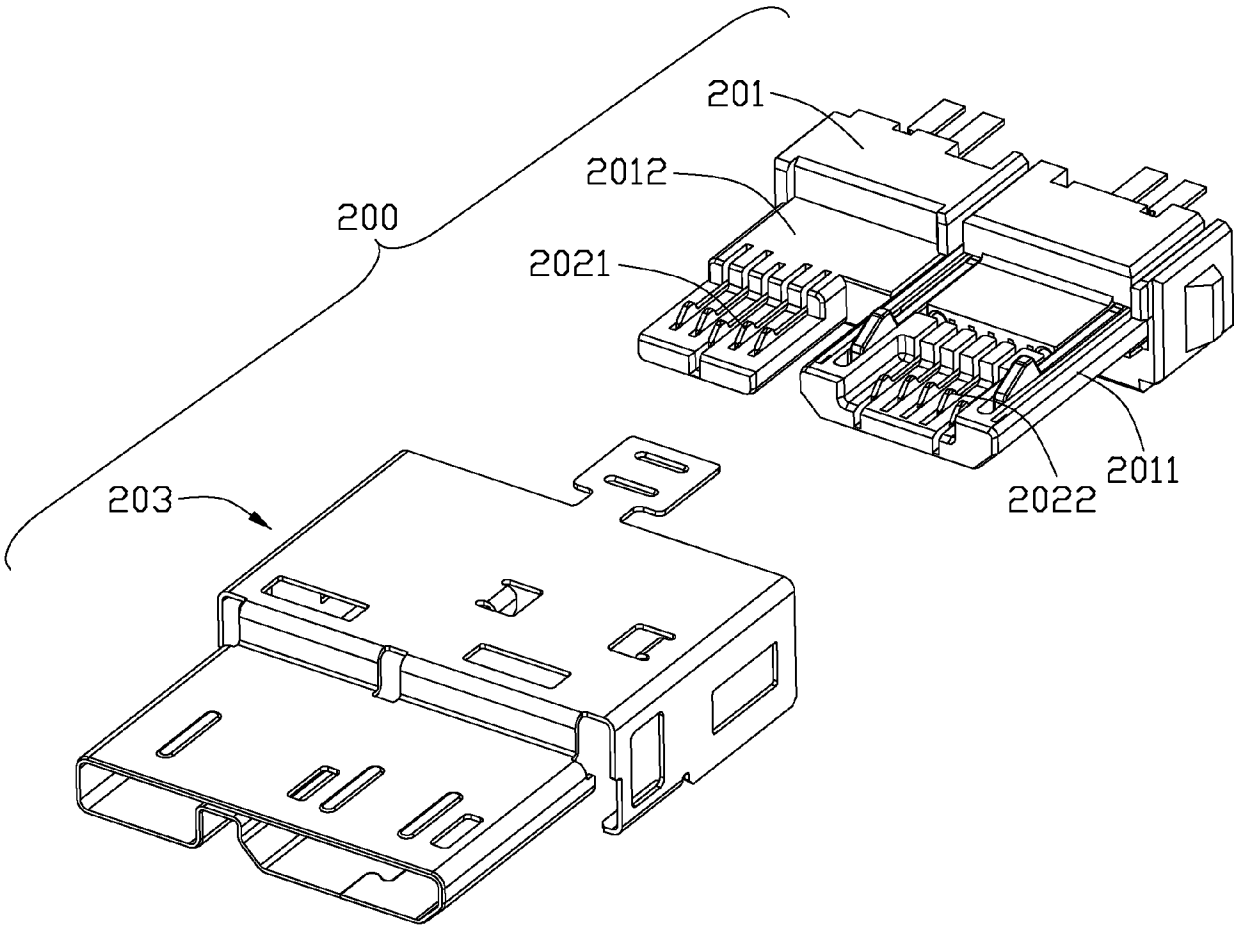
FIG. 7 is a partially assembled perspective view of the plug connector.
Figure 8:
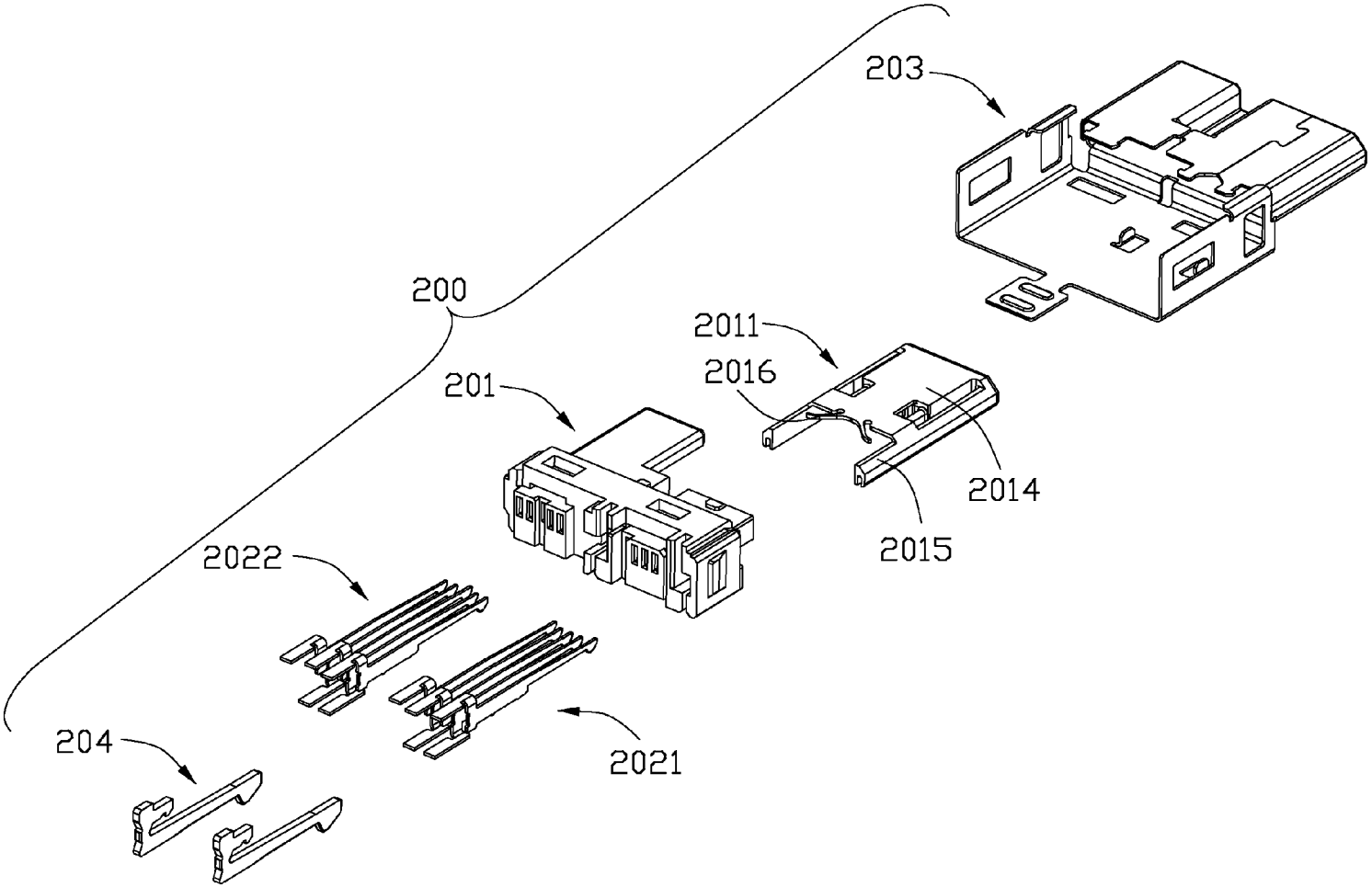
FIG. 8 is an exploded perspective view of the plug connector.
Figure 9:
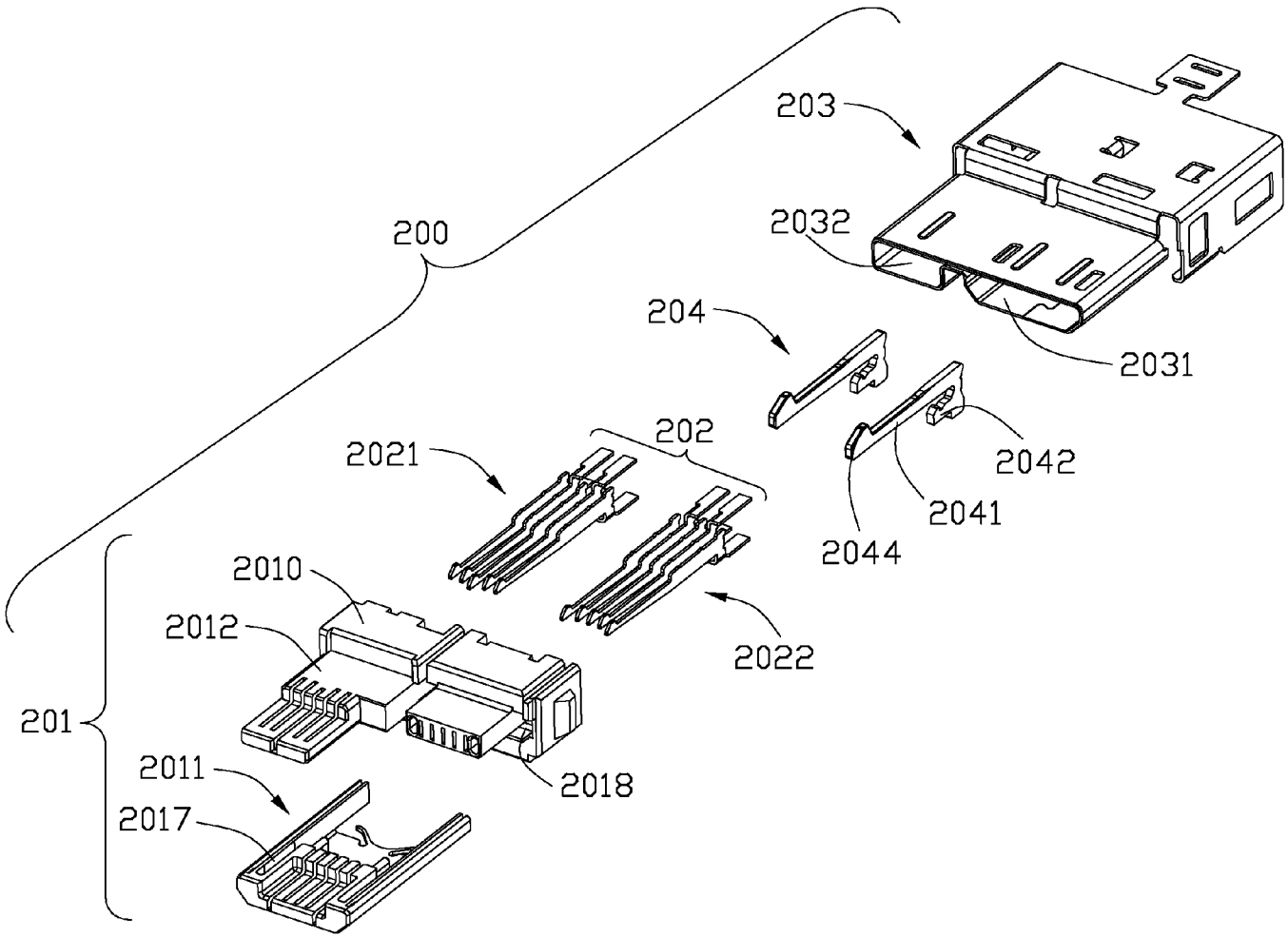
FIG. 9 is similar to FIG. 8, but viewed from a different aspect.

Referring to FIGS. 7-9, the second connector 200 is a plug connector and adapted for connecting to a cable/wire (not shown). The second connector 200 includes a dielectric housing 201, a plurality of terminals 202 mounted to the dielectric housing 201, a metal shell 203 enclosing the dielectric housing 1 and two latching members 204 mounted to the dielectric housing 201.

The dielectric housing 201 has a transversal main portion 2010, a first terminal seat 2011 and a second terminal seat 2012 extending forwardly from the main portion 2010. The first terminal seat 2011 and the second terminal seat 2012 are separated from each other along a transversal direction. The first terminal seat 2011 has a body portion 2014 and two mounting arms 2015 extending backwardly from lateral sides of the body portion 2014. In addition, there is a Y-shaped elastic member 2016 formed at a back side of the body portion 2014 and disposed between the two mounting arms 2015. There are two slots 2017 respectively defined in lateral sides of the body portion 2014 and located adjacent to the mounting arms 2011, respectively. The first terminal seat 2011 is assembled to the dielectric main portion 2010, with the two mounting arms 2015 inserted into corresponding mounting hole 2018 in the main portion 2010. Therefore, the first terminal seat 2011 is floatable regarding to the main portion 2010 biased by the elastic member 2016. The second terminal seat 2012 is integrally formed with the main portion 2010.

The terminals 202 include a set of first terminals 2021 and a set of second terminals 2022 which are respectively mounted to the first terminal seat 2011 and the second terminal seat 2012. The first terminals 2021 are in accordance with Micro USB contact arrangement; while the second terminals 2022 are in accordance with Micro USB 3.0 arrangement, with two differential signal contacts and a grounding contact disposed therebetween. The metal shell 203 has a first receiving port 2031 and a second receiving port 2032 for accommodating the first terminal seat 2011 and the second terminal seat 2012.

The latching member 204 includes a latching arm 2041 accommodated in the corresponding slot 2017 of the body portion 2014 and the retention portion 2042 locked into the main portion 2010. There is a hook 2044 formed at a front end of the latching arm 2041 latching with the locking hole 34 when the first connector 100 mating with the second connector 200.

Figure 10:
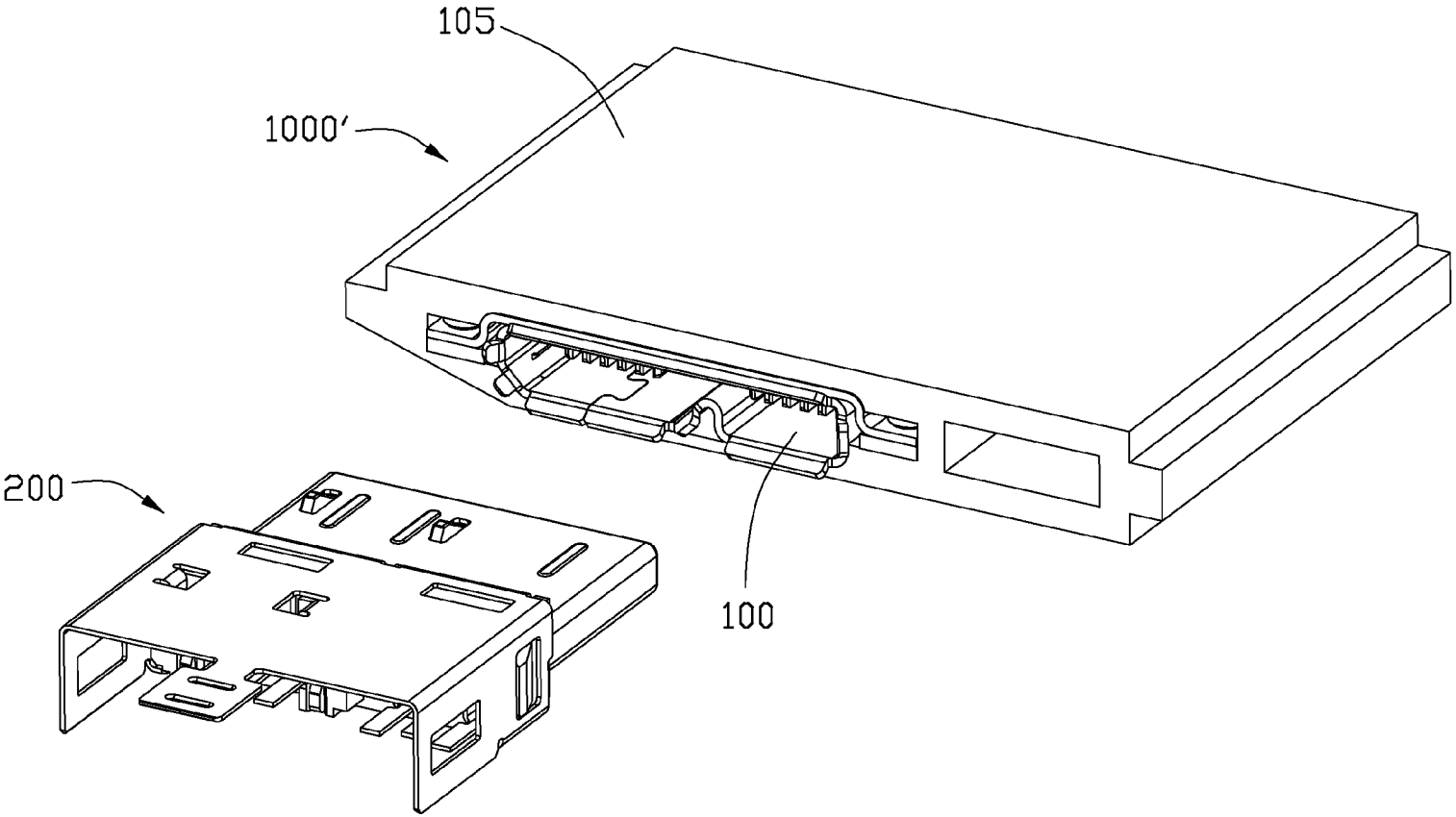
FIG. 10 is a perspective view of a board-mount connector assembly and a plug connector adapted for mating with the board-mount connector assembly of a second embodiment in accordance with the present invention.
Figure 11:
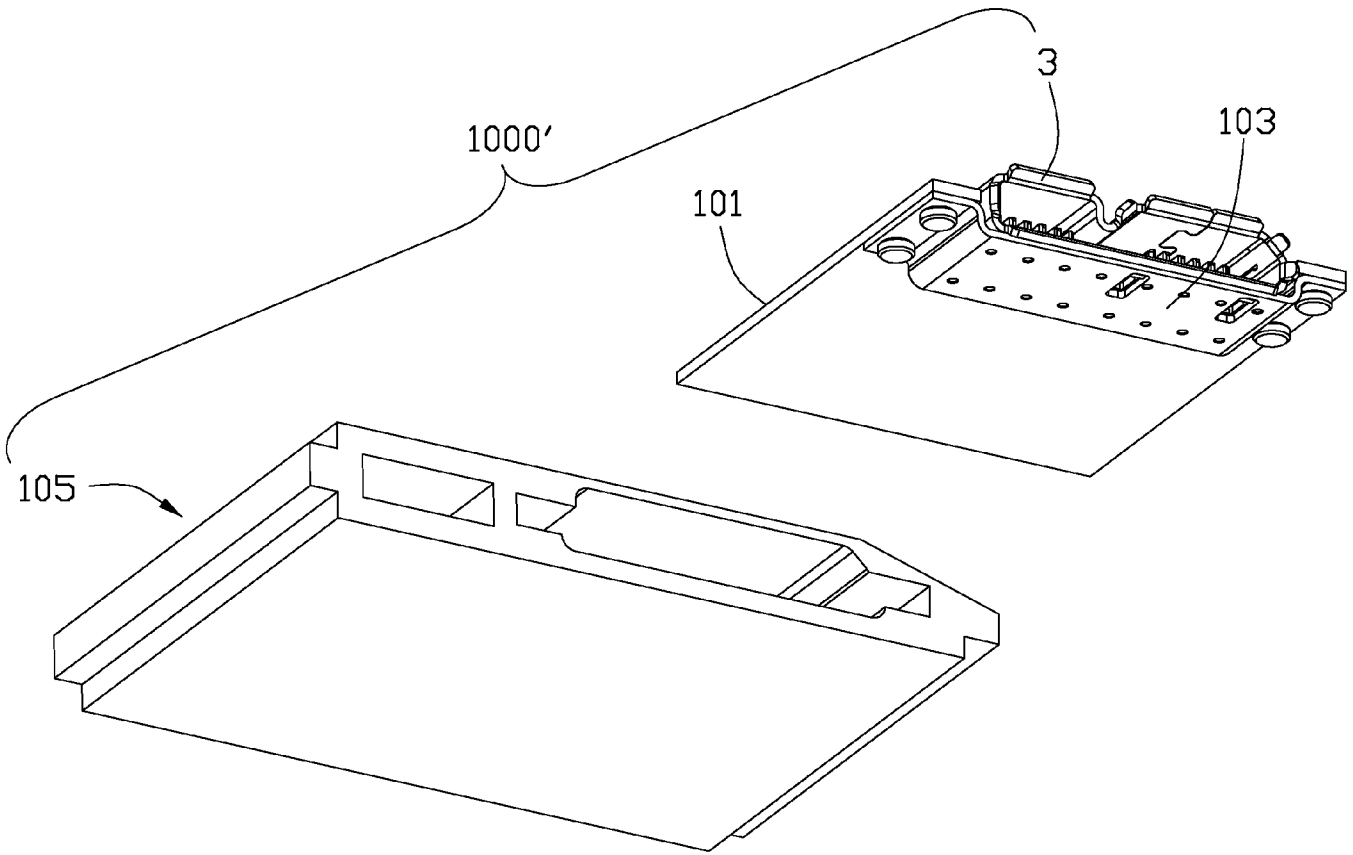
FIG. 11 is a partially assembled, perspective view of the board-mount connector assembly.
Figure 12:
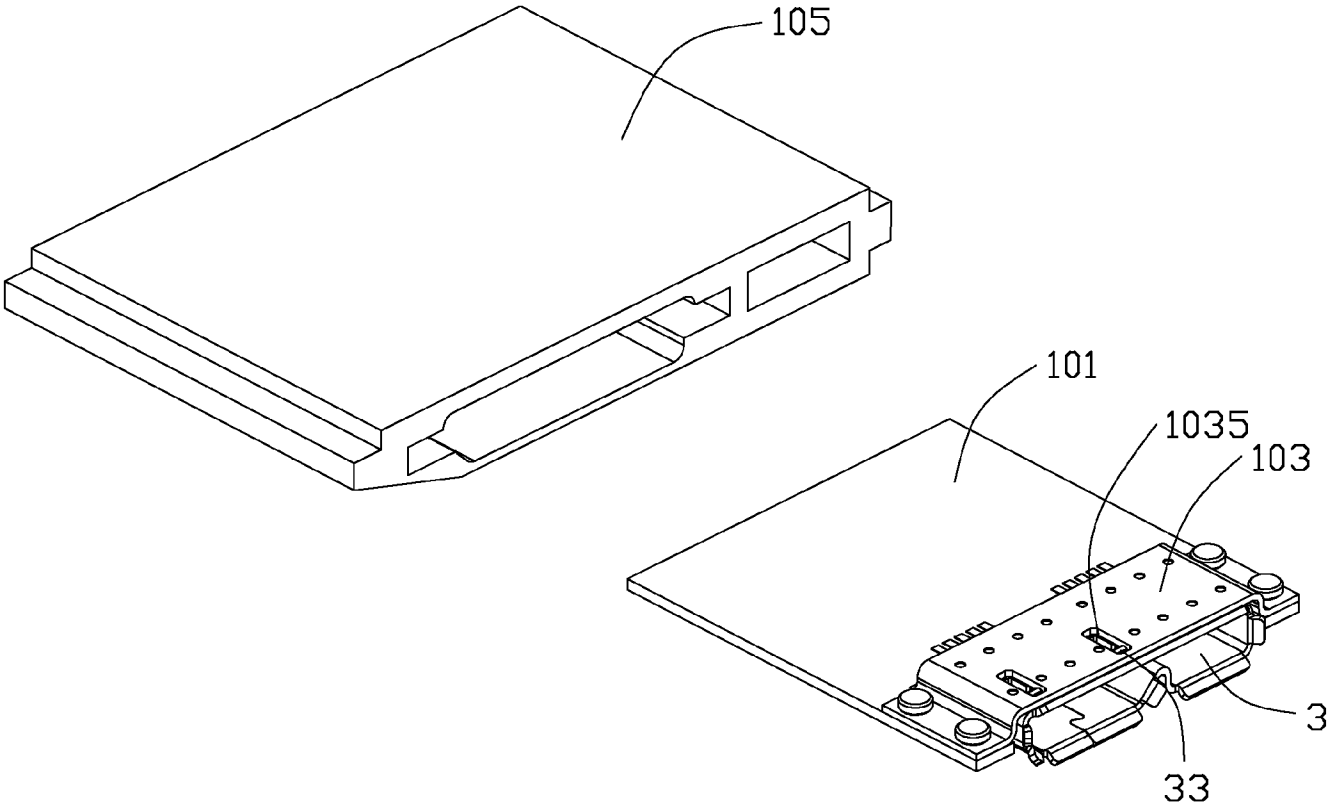
FIG. 12 is similar to FIG. 11, but viewed from other aspect.
Figure 13:
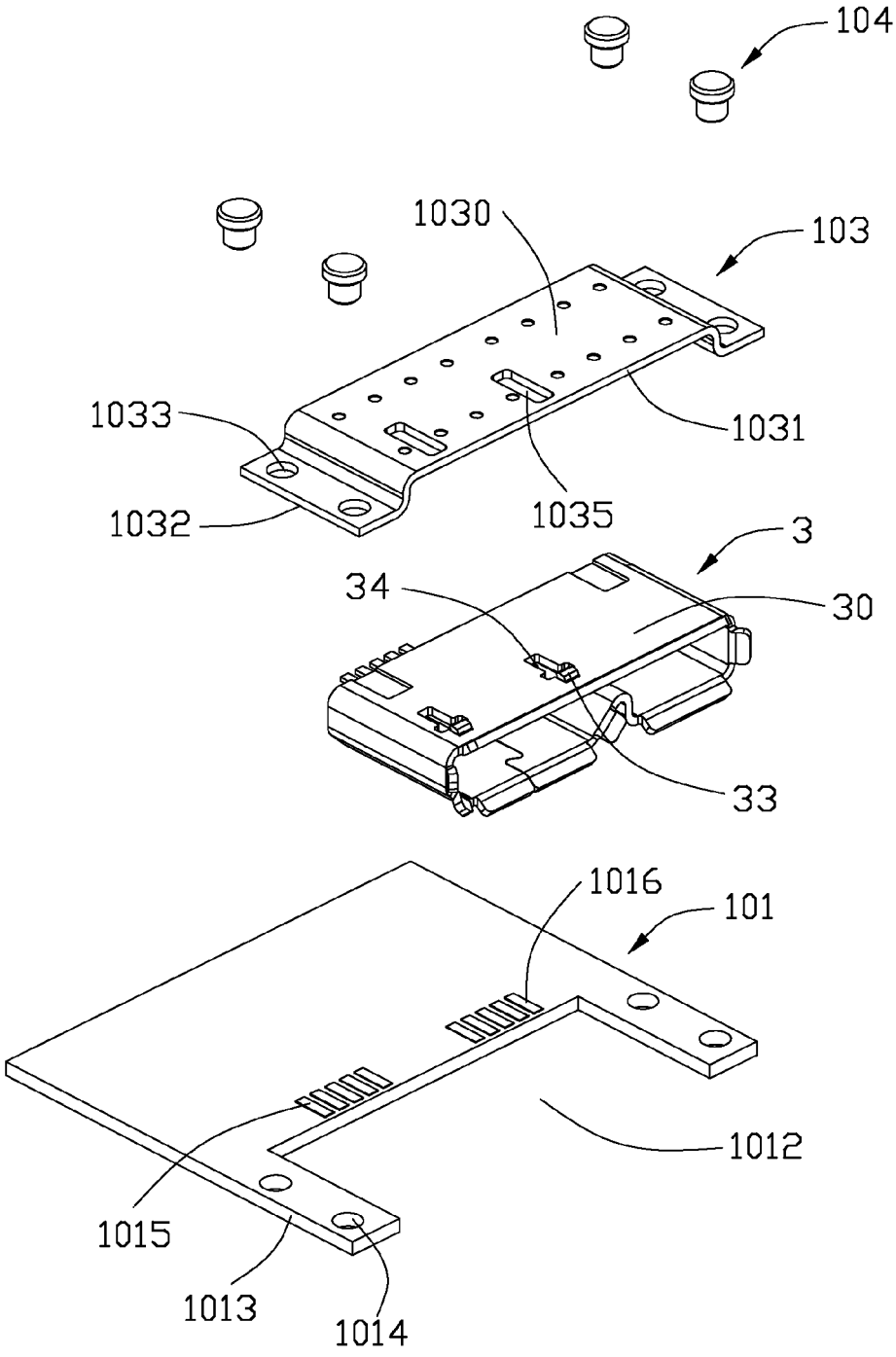
FIG. 13 is an exploded perspective view of the board-mount connector assembly.
Figure 14:
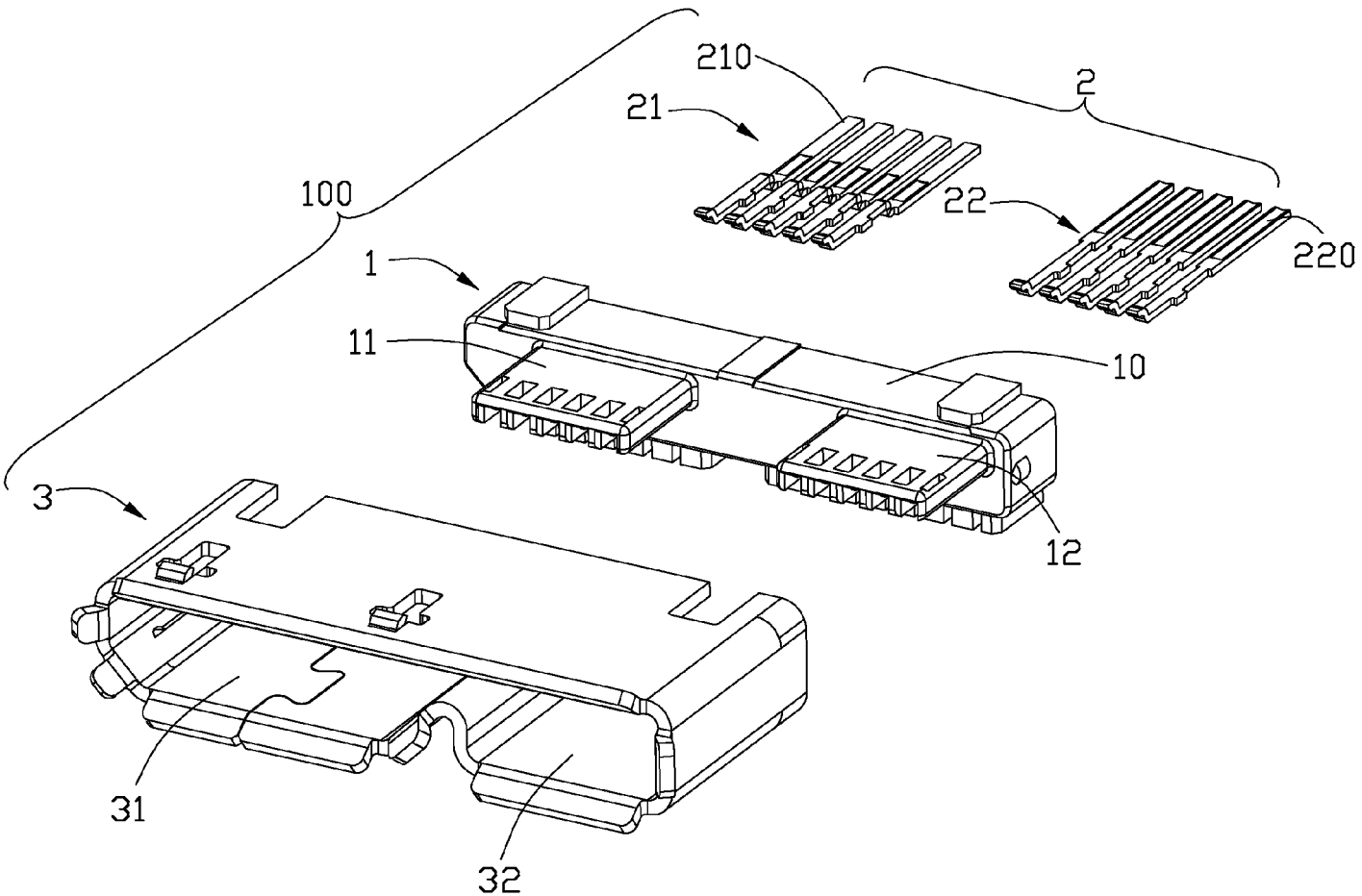
FIG. 14 is an exploded perspective view of a receptacle connector in FIG. 13.
Figure 15:
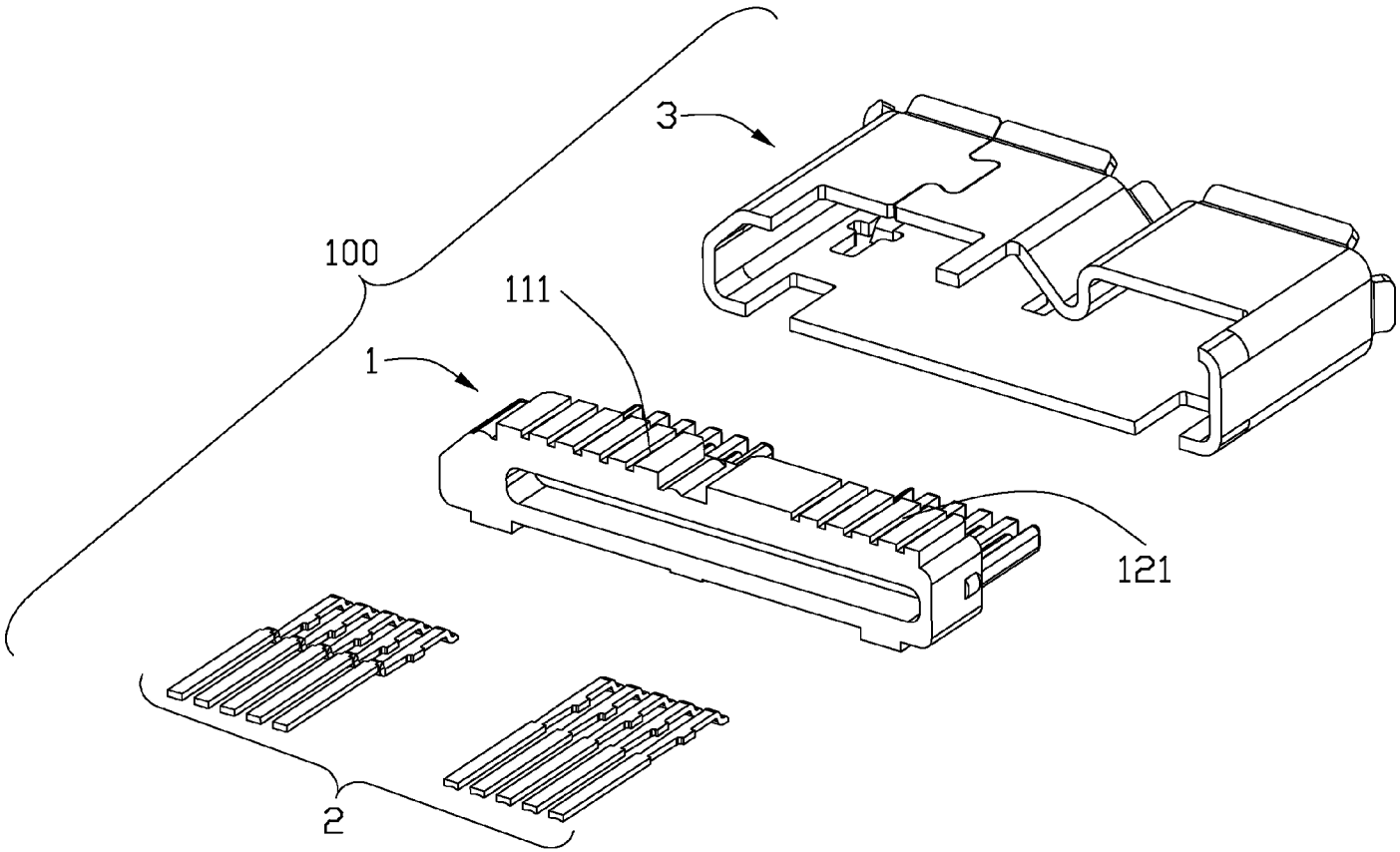
FIG. 15 is similar to FIG. 14, but viewed from other direction.

Referring to FIG. 10, a board-mount connector assembly 1000' with a first connector 100 adapted for mating with a second connector 200 of a second embodiment in accordance with the present invention.

Referring to FIGS. 11-15, the board-mount connector assembly 1000' includes a substrate 101, a first connector 100, a bracket 103 mounted to the substrate 101 to support the first connector 100 and a cover 105 enclosing the first connector 100 and the substrate 101. The first connector 100 is a receptacle connector.

The first connector 100 is a universal serial bus (USB) connector and includes an insulative housing 1, a plurality of contacts 2 mounted to the insulative housing 1, a metallic shell 3 enclosing the insulative housing 1.

The insulative housing 1 has a transversal base portion 10, a first tongue portion 11 and a second tongue portion 12 extending forwardly from the base portion 10. The first tongue portion 11 and the second tongue portion 12 are separated from each other along a transversal direction. The first tongue portion 11 has a plurality of first contact grooves 111, and the second tongue portion 12 also has a plurality of second contact grooves 121. The first contacts 21 and the second contacts 22 are respectively accommodated in the first contact grooves 111 and the second contact grooves 121. The first contacts 21 are in accordance with Micro USB contact arrangement; while the second contacts 22 are in accordance with Micro USB 3.0 arrangement, with two differential signal contacts and a grounding contact disposed therebetween. The metallic shell 3 has a first receiving port 31 and a second receiving port 32 for accommodating the first tongue portion 11 and the second tongue portion 12. The first receiving port 31 and the second receiving port 32 have different shape.

The substrate 101 further has a flash memory chip (not shown) and other electronic elements (not shown) located thereon. Therefore, the substrate 101 is substantially a memory card. The substrate 101 defines a cutout 1012 at a front segment thereof. There are two arms 1013 located at opposite sides of the cutout 1012. Each arm 1013 defines two mounting holes 1014 and arranged along a front-to-back direction. In addition, there are a set of first conductive pads 1015 and a set of second conductive pads 1016 formed on the front segment of the substrate 101. The first and second conductive pads 1015, 1016 further are further connected to the flash memory chip and the other elements; detailed description is omitted, as that is very familiar to one in the art.

The bracket 103 has a U-shaped retainer 1031 and two horizontal mounting portions 1032 outwardly extending from upper edges of the U-shaped retainer 1031. There are two holes 1033 defined in each mounting portion 1032. In addition, there are two positioning slots 1035 located on a bottom side 1030 of the retainer 1032. There are two protrusions 33 formed on a lower side 30 of the metallic shell 3 and two locking holes 34 defined in the lower side 30 and disposed behind the protrusions 33.

The bracket 103 is assembled to the substrate 101, with the retainer 1031 disposed under the cutout 1012 and the two mounting portions 1032 placed on the two arms 1013. The mounting portions 1032 and the arms 1013 are combined together, with corresponding rivets 104 assembled to the holes 1033 of the mounting portions 1032 and the mounting holes 1014 of the arms 1013. The first connector 100 is mounted to the retainer 1031 and sinks inside the cutout 1012 of the substrate 101, with the lower side 30 of the metallic shell 30 placed on the bottom side 1030 of the retainer 1032, the protrusions 33 inserted into the positioning slots 1035, and the locking holes 34 aligning with the positioning slots 1035. Tail portions 210, 220 of the first contacts 21 and the second contacts 22 are soldered to the first conductive pads 1015 and the second conductive pads 1016. By such arrangement, a total dimension of the connector assembly 1000 is reduced, both along the longitudinal direction and along the transversal direction.

While preferred embodiments in accordance with the present invention have been shown and described, equivalent modifications and changes known to persons skilled in the art according to the spirit of the present invention are considered within the scope of the present invention as described in the appended claims.

What is claimed is:

1. A board-mount connector assembly, comprising:
- a substrate defining a cutout;
- a bracket attached to the substrate and spanning over the cutout; and
- a connector attached to the bracket and disposed at least a portion within the cutout; and
- at least one wire connected to the connector;
- wherein the connector includes an insulative housing and a plurality of contacts mounted to the insulative housing, and there is a plurality of wires connected to the contacts, respectively;
- wherein the insulative housing defines a first tongue portion and a second tongue portion both with same amount of contacts.

2. The board-mount connector assembly as claimed in claim 1, wherein the bracket is disposed under the cutout.

3. The board-mount connector assembly as claimed in claim 1, wherein the substrate has two arms disposed at opposite sides of the cutout.

4. The board-mount connector assembly as claimed in claim 3, wherein the bracket has a U-shaped retainer and two horizontal mounting portions outwardly extending from upper edges of the U-shaped retainer.

5. The board-mount connector assembly as claimed in claim 4, wherein the retainer is located under the cutout of the substrate, and the horizontal mounting portions are respectively combined with the arms of the substrate.

6. The board-mount connector assembly as claimed in claim 5, wherein each arm defines at least one mounting hole and the mounting portion defines at least one hole to receiving a corresponding rivet.

7. The board-mounted connector assembly as claimed in claim 1, wherein the retainer has a bottom side, and the connector has a metallic shell with a lower side supported by the bottom side of the retainer.

8. The board-mount connector assembly as claimed in claim 1, wherein the contacts on the first tongue portion and the contacts of the second tongue portion for transmitting different signals.

9. A board-mount connector assembly with a first connector adapted for mating a second connector, comprising:
- a memory card with a substrate defining a cutout and two arms disposed at opposite sides of the cutout;
- a bracket mounted to the substrate and disposed under the cutout; and
- the first connector supported by the bracket, and
- a cover enclosing the substrate, the bracket and the first connector.

10. The board-mount connector assembly as claimed in claim 9, wherein the first connector and the second connector both have five contacts including two differential signal contacts and a grounding contact disposed between the two differential signal contacts.

11. The board-mount connector assembly as claimed in claim 9, wherein the first connector includes an insulative housing, a plurality of contacts mounted to the insulative housing and a metallic shell enclosing the insulative housing.

12. The board-mount connector assembly as claimed in claim 9, wherein the second connector includes a dielectric housing with two terminal seats, a plurality of terminals arranged into two groups and mounted to the two terminal seats respectively.

13. The board-mount connector assembly as claimed in claim 12, wherein one of the terminal seat is floatable regarding to the other terminal seat.

14. An electrical connector assembly comprising:
- a PCB (Printed Circuit Board) defining a cutout;
- a first connector including a first insulative housing enclosed in a first metallic shell to commonly define two mating ports communicatively spaced from each other in a transverse direction while commonly communicating with an exterior in a front-to-back direction perpendicular to said transverse direction, said first connector being dimensioned complying with that of the cutout and snugly received in the cutout in a sink type;
- a metallic bracket covering essentially both said cutout and the first connector, with a horizontal wall retaining the connector thereto and two opposite wings secured to the PCB by two sides of the cutout;
- a case enclosing all said PCB, said bracket and said first connector.

15. The electrical connector assembly as claimed in claim 14, wherein said first shell defines a pair of through holes for securing corresponding latches of a second connector mated with the first connector.

16. The electrical connector assembly as claimed in claim 15, wherein the bracket defines another pair of through holes in alignment with the corresponding pair of through holes in the shell for receiving the corresponding latches of the second connector.

17. The electrical connector assembly as claimed in claim 14, wherein said first connector includes a plurality of contacts connected with corresponding wires.

18. The electrical connector assembly as claimed in claim 14, wherein said first connector includes a plurality of contacts connected upon the PCB.

19. The electrical connector assembly as claimed in claim 14, wherein said horizontal wall is a top wall of the bracket.

20. The electrical connector assembly as claimed in claim 14, wherein said two wings extend horizontally.

* * * * *